US007564418B2

(12) United States Patent
Krupa et al.

(10) Patent No.: US 7,564,418 B2
(45) Date of Patent: Jul. 21, 2009

(54) TWIN GROUND ANTENNA

(75) Inventors: Steve Krupa, Tempe, AZ (US); Stefan Quantz, Tianjin (CN); Snir Azulay, Tiberias (IL)

(73) Assignee: Galtronics Ltd., Tiberias (IL)

( * ) Notice: Subject to any disclaimer, the term of this patent is extended or adjusted under 35 U.S.C. 154(b) by 78 days.

(21) Appl. No.: 11/737,494

(22) Filed: Apr. 19, 2007

(65) Prior Publication Data

US 2007/0247383 A1 Oct. 25, 2007

Related U.S. Application Data

(60) Provisional application No. 60/794,278, filed on Apr. 21, 2006.

(51) Int. Cl.
*H01Q 11/12* (2006.01)
*H01Q 7/00* (2006.01)

(52) U.S. Cl. ..... 343/741; 343/866

(58) Field of Classification Search ..... 343/741, 343/743, 866, 725, 728
See application file for complete search history.

(56) References Cited

U.S. PATENT DOCUMENTS 5,701,130 A * 12/1997 Thill et al. ..... 343/895
7,271,769 B2 9/2007 Asano et al.
7,385,561 B2 * 6/2008 Krupa ..... 343/728

OTHER PUBLICATIONS

U.S. Appl. No. 60/794,278, filed Apr. 21, 2006.

* cited by examiner

*Primary Examiner*—Hoang V Nguyen
(74) *Attorney, Agent, or Firm*—Darby & Darby P.C.

(57) ABSTRACT

An antenna, consisting of a folded looped conductor closed at a feedpoint. The antenna has at least two conductive arms extending from the feedpoint.

17 Claims, 4 Drawing Sheets

TWIN GROUND ANTENNA

CROSS-REFERENCE TO RELATED APPLICATION

This application claims the benefit of U.S. Provisional Patent Application 60/794,278, filed 21 Apr. 2006, which is incorporated herein by reference.

FIELD OF THE INVENTION

The present invention relates generally to antennas, and specifically to antennas that may be used in multiple bands.

BACKGROUND OF THE INVENTION

Electronic devices which receive and transmit electromagnetic radiation, such as laptop computers, are continually reducing in size. The reduction in size typically constrains an antenna of the device, so that the efficiency of operation of the antenna may be adversely affected.

There is thus a need for an improved antenna.

SUMMARY OF THE INVENTION

In embodiments of the present invention, a multi-band antenna is formed from a conducting element that is in the form of a folded loop. Two ends of the loop are closed, galvanically or capacitively, at a region which is used as a feedpoint for the antenna. In addition, two or more conductive arms extend from the feedpoint, and each arm may be of a different length. For example, in the case of two arms, a first arm may be short, acting as a radiator for a high-frequency band, and a second arm may be long, acting as a radiator for a low-frequency band. A connection is made to one or more points on the folded loop to act as a ground. In the exemplified case of two arms, one side of the loop typically acts as a high-frequency ground leg, and the other side of the loop acts as a low-frequency ground leg. The antenna may advantageously be configured from one piece of conducting wire.

In one embodiment, the folded loop may be arranged to compactly fold around a coaxial cable which feeds signals to the antenna. The center conductor of the cable is connected to the feedpoint, and the shield of the cable is connected to one or more points of the loop.

In an alternative embodiment, the folded loop straddles a printed circuit board (PCB) and the feedpoint corresponds to the region where the two ends of the loop grip the PCB. In some embodiments the two ends are connected galvanically through the PCB by a via or plated-through holes. Alternatively, the two ends are not connected galvanically through the PCB, but couple capacitively. A section of the loop, typically a part which contacts the edge of the PCB, may be placed in galvanic contact with a ground plane of the PCB, the section thus acting as a ground connection for the loop. In the case of the two arm antenna referred to above, each arm may be positioned on an opposite side of the PCB.

There is therefore provided, according to an embodiment of the present invention, an antenna, including:

a folded looped conductor closed at a feedpoint; and at least two conductive arms extending from the feedpoint.

Typically, the at least two conductive arms have a common near field, and at least one region of the folded looped conductor may be operative as a ground point.

In one embodiment the at least two conductive arms radiate in respective wireless communication bands.

In a disclosed embodiment the folded looped conductor and the at least two conductive arms are formed from a single conductive element.

Typically, at least one of the folded looped conductor and the at least two conductive arms are formed from a conductive element having a circular cross-section. Alternatively, at least one of the folded looped conductor and the at least two conductive arms are formed from a conductive element having a non-circular cross-section.

In some embodiments an electrical characteristic of the antenna is altered by a change of geometry of at least one of the folded looped conductor and the at least two conductive arms, while maintaining a topology of the folded looped conductor and the at least two conductive arms. The change of geometry may include a bending of at least one of the conductive arms. Alternatively or additionally, the change of geometry may include a change in folding of the folded looped conductor.

In an alternative embodiment the folded looped conductor may be configured to receive a coaxial cable, so that the feedpoint contacts a central conductor of the cable, and so that at least one region of the folded loop contacts a shield of the cable.

In a further alternative embodiment the antenna includes a printed circuit board (PCB), wherein the folded looped conductor and the at least two conductive arms are disposed to straddle the PCB so that the PCB is gripped by the folded looped conductor at the feedpoint.

In a yet further alternative embodiment the antenna includes a PCB having a ground plane disposed on a side of the PCB, wherein the folded looped conductor and the at least two conductive arms are disposed to straddle the PCB so that a region of the folded looped conductor galvanically contacts the ground plane.

Typically, the folded looped conductor includes a plurality of first regions lying in a first plane and a plurality of second regions lying in a second plane that is parallel to and separate from the first plane. The folded looped conductor may have a plane of symmetry parallel to the first and the second plane.

The folded looped conductor may include two straight parallel regions which are configured to connect galvanically to a conductive ground plane.

The folded looped conductor may include two ends which are galvanically coupled so as to close the folded looped conductor galvanically at the feedpoint. Alternatively, the folded looped conductor may include two ends which are capacitively coupled so as to close the folded looped conductor capacitively at the feedpoint.

There is further provided, according to an embodiment of the present invention, a method for forming an antenna, including:

configuring a conductive element into a folded looped conductor closed at a feedpoint; and extending at least two conductive arms from the feedpoint.

Typically, the method includes forming the conductive element and the at least two conductive arms from a single conductor.

The present invention will be more fully understood from the following detailed description of the embodiments thereof, taken together with the drawings in which:

DETAILED DESCRIPTION OF EMBODIMENTS

Figures 1A, 1B:
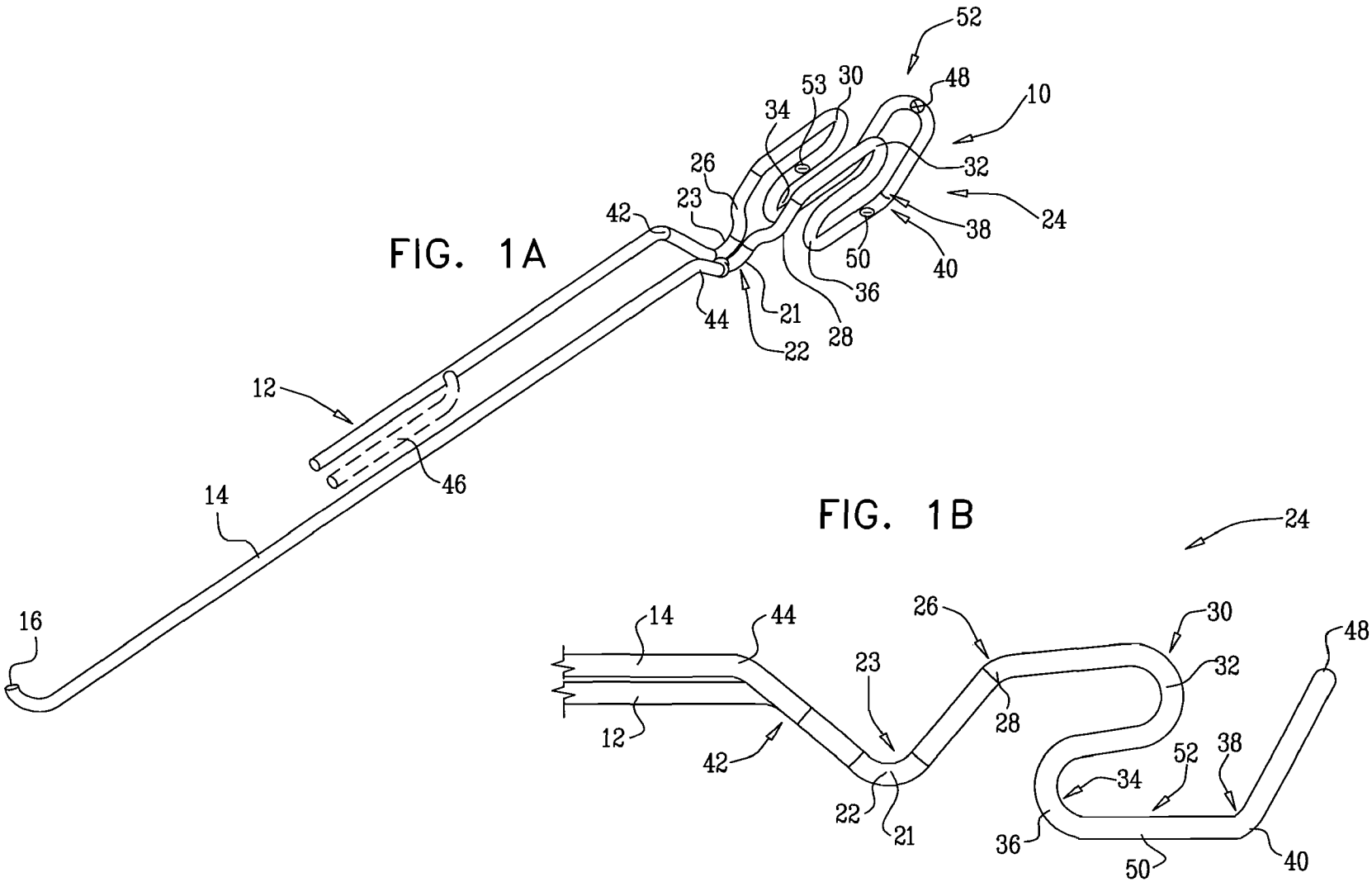
FIGS. 1A, 1B, and 1C, are schematic diagrams of an antenna, according to an embodiment of the present invention.
Figure 1C:
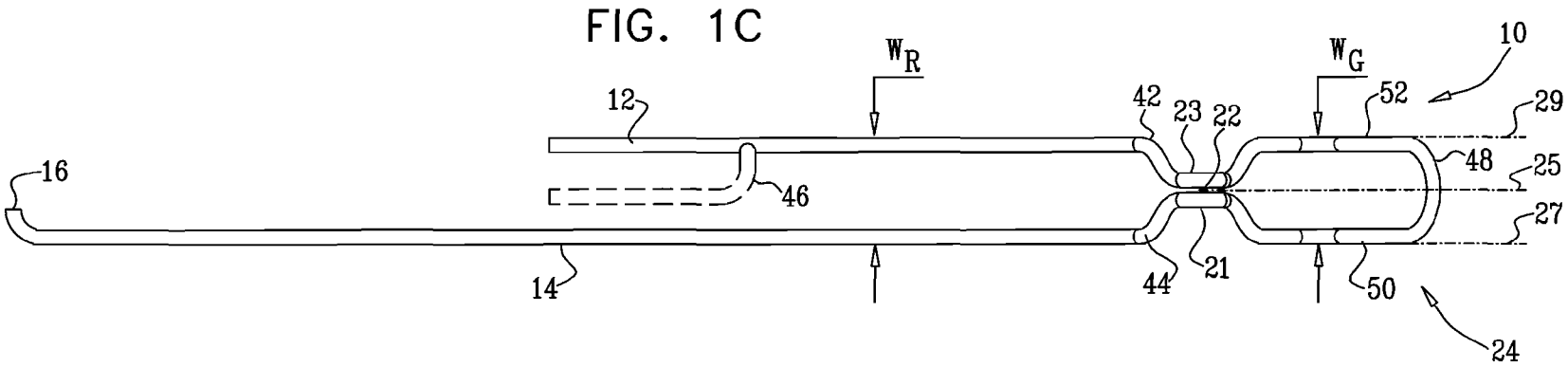

Reference is now made to FIGS. 1A, 1B, and 1C, which are schematic diagrams of an antenna 10, according to an embodiment of the present invention. FIG. 1A is a schematic perspective view of the antenna, FIG. 1B is a schematic side view of a part of the antenna, and FIG. 1C is a schematic top view of the antenna. Antenna 10 may be formed from one conductor, typically a wire having spring temper properties that enable the wire to be bent to the required shape and to hold the shape after bending. In one embodiment, the conductor has a substantially circular cross-section. In alternative embodiments, the conductor has a non-circular cross-section, for example a rectangular cross-section. Further alternatively, typically for the conductor having a substantially circular cross-section, the conductor may be hollow.

Alternatively, antenna 10 may be formed from two or more conductors having generally similar properties to those described above for the one conductor.

In the following description, unless otherwise stated, antenna 10 is assumed to be formed from one conductive wire having a substantially circular cross-section.

Antenna 10 comprises a folded closed loop 24 which has a plane of symmetry 25 that corresponds to the plane of FIG. 1B. FIG. 1B shows a schematic side view of the loop. Loop 24 may be considered to be formed from a generally flat "O" shaped loop that is bent and/or folded at regions 26, 28, 30, 32, 34, 36, 38, and 40 of the loop. Loop 24 is formed so that regions 28, 32, 36 and 40 approximately lie in a plane 27, and regions 26, 30, 34, and 38 approximately lie in a plane 29, planes 27 and 29 being substantially equidistant from, and parallel with, plane of symmetry 25.

Table I below gives approximate angles for the loop, in a disclosed embodiment, at the regions referenced above. The angles listed are considered as being measured in their respective planes. It will be understood that the angles listed in the table are approximate, and typically may be varied by of the order of +/−20% or more.

TABLE I

| Region of loop | Angle of region |
|---|---|
| 26, 28 | 135° |
| 30, 32 | 180° |
| 34, 36 | 170° |
| 38, 40 | 135° |

The folded/bent regions of loop 24 described above form a generally semi-circular region 48, and two generally straight parallel regions 50 and 52. Loop 24 has end points 21 and 23 which are arranged to substantially meet at a region 22. As is described in more detail below, one or more regions of loop 24, other than region 22, act as a multiple ground for antenna 10, by being connected to a ground of a device using the antenna.

A plurality of arms extend in a spread manner from region 22, each arm acting as a monopole. Typically, the arms are configured to have different lengths, so as to radiate at different frequencies such as cellular communication band frequencies. By way of example, antenna 10 is herein assumed to comprise two arms 12 and 14 extending from region 22. Arms 12 and 14 are arranged to be generally parallel to each other, and typically to be close enough so that each arm is within the near field of the other arm. By way of example, arm 12 is assumed to be bent at a region 42, and arm 14 is assumed to be bent at a region 44, the angle of bending for both regions being approximately 135°.

Additional bends may be made in arms 12 and/or 14. For example, arm 14 may be bent at end 16, typically so as to shorten an overall length of antenna 10. In one embodiment, illustrated by broken lines in the figures, arm 12 is bent so that a portion 46 of the arm is closer, while remaining parallel, to arm 14.

To operate antenna 10, region 22 is used as a feedpoint, and one or more regions of loop 24 are used as ground regions. Examples of the use of antenna 10 are described in more detail below.

Figure 2:
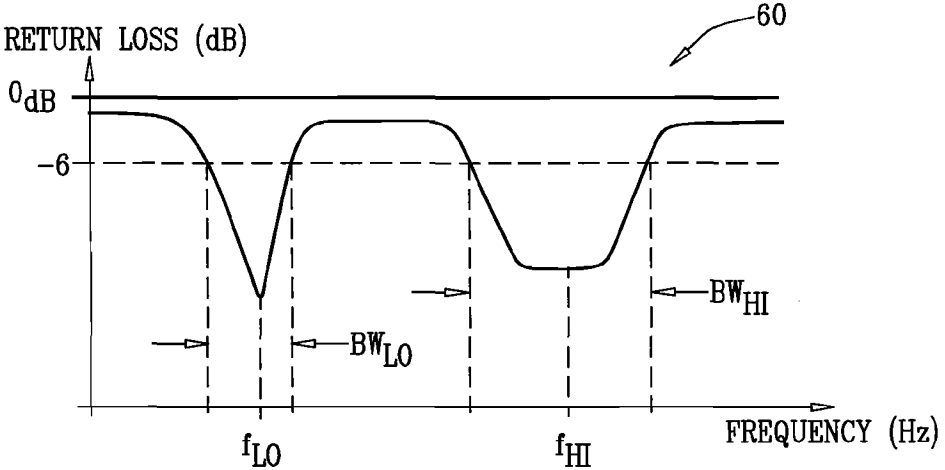
FIG. 2 is a schematic graph of return loss vs. frequency for the antenna, according to an embodiment of the present invention.

FIG. 2 is a schematic graph 60 of return loss vs. frequency for antenna 10, according to an embodiment of the present invention. Antenna 10 radiates in a low frequency band approximately centered at a resonant low frequency $f_{LO}$, having a 6 dB bandwidth $BW_{LO}$. The antenna also radiates in a high frequency band approximately centered at a resonant high frequency $f_{HI}$, having a 6 dB bandwidth $BW_{HI}$. The values of $f_{LO}$ and $f_{HI}$ are respectively primarily determined by the lengths of arms 14 and 12 respectively, and may, for example, be adjusted for two wireless communication bands. For example, if arm 12 is approximately 3 cm long, $f_{HI}$ is approximately 1.9 GHz, and if arm 14 is approximately 6 cm long, $f_{LO}$ is approximately 900 MHz, the frequencies corresponding to two of the GSM (Global System for Mobile Communications) bands. The values of $f_{LO}$ and $f_{HI}$ typically decrease as a distance $W_R$ (FIG. 1C) between arms 12 and 14 is reduced, due to increased radio-frequency (RF) coupling between the arms. A typical mean value for $W_R$ is approximately 1 cm, since good values of bandwidth $BW_{LO}$ and $BW_{HI}$ typically require that there is adequate separation between the arms. However, rather than adjusting the complete arms to vary $W_R$, in some embodiments only a portion of one of the arms, such as portion 46, is adjusted, by appropriate bending of the portion. Portion 46 may also be bent to adjust matching and/or tuning of antenna 10.

Other elements of antenna 10 that affect its performance, and which are typically also reflected in graph 60, are described below.

Figure 3A:
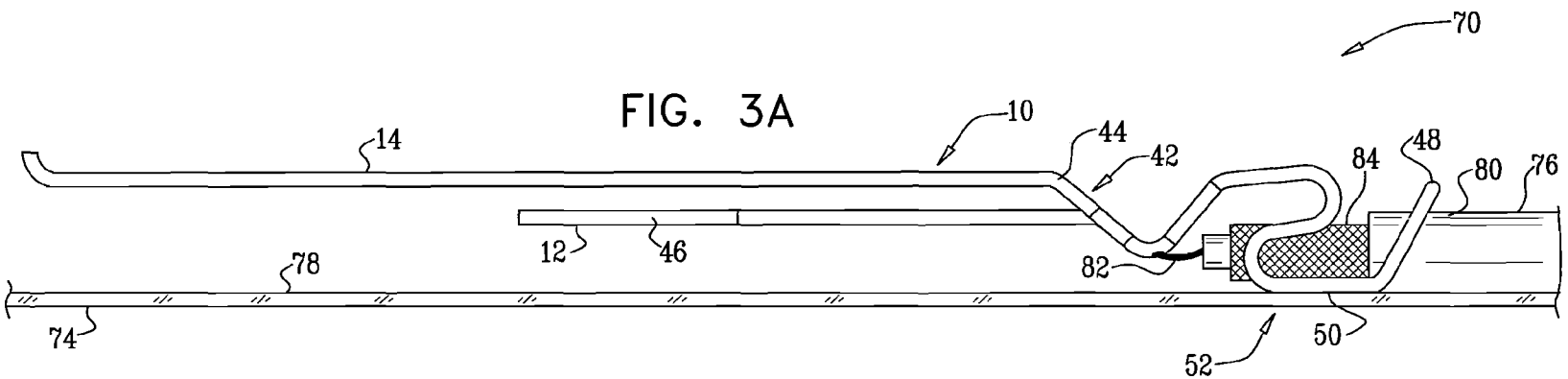
FIGS. 3A and 3B illustrate a method for mounting the antenna, according to an embodiment of the present invention.
Figure 3B:
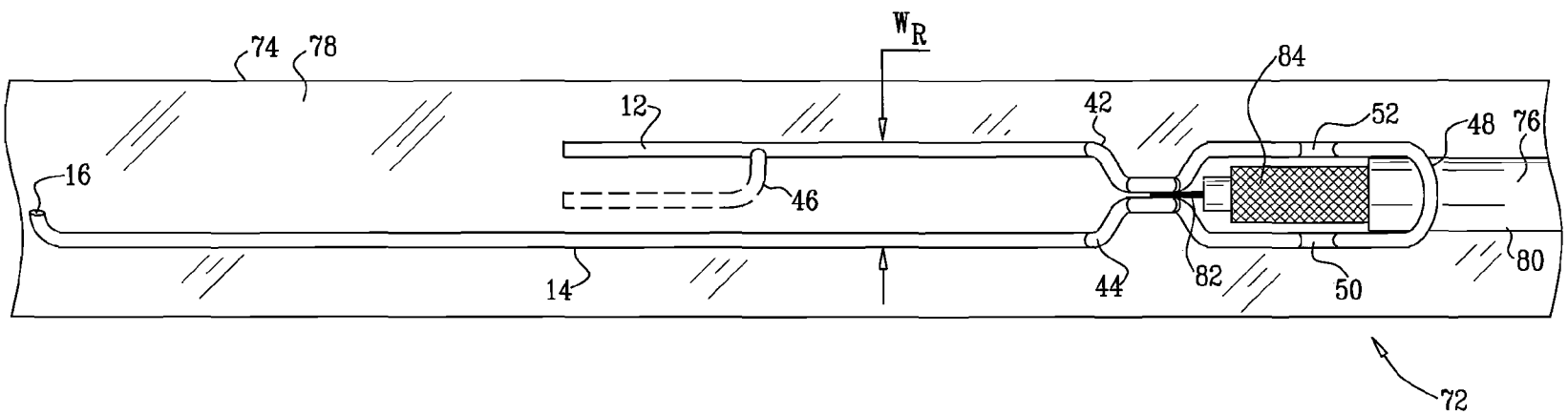

FIGS. 3A and 3B illustrate a method for mounting antenna 10, according to an embodiment of the present invention. A diagram 70 shows a side view of the antenna, and a diagram 72 shows a top view. Antenna 10 is mounted on a bracket 74, only part of which is shown in diagrams 70 and 72. Bracket 74 has a conductive ground plane 78, which typically acts as a counterpoise for antenna 10. Antenna 10 is mounted by straight regions 50, 52 of loop 24 onto ground plane 78, typically by the regions being soldered to the ground plane.

A coaxial cable 76 having an outer dielectric sleeve 80 feeds the antenna. The cable is mounted within loop 24 so that semi-circular region 48 holds the cable in place. A bared central conductor 82 of the cable contacts, and is soldered to, feedpoint region 22. The solder forms a conductive bridge between ends 21 and 23 of loop 24, so that the loop is galvanically closed, and the bridge acts as a good RF path between arms 12 and 14. A bared section 84 of the ground shield of cable 76 is positioned between straight regions 50 and 52, and is soldered to the regions. Regions 50 and 52 thus act as grounding points for the antenna.

The solder positions described above, together with the positioning of cable 76 within loop 24 so that region 48 encloses the cable, provide a compact and mechanically strong method for mounting the cable and antenna on bracket 74. Folded loop 24 captures the cable, and holds it flat against bracket 74 so that the soldering described above may be easily performed. Typically, as illustrated in FIGS. 3A and 3B, angles of regions 42 and 44, as well as the parts of arms 12 and 14 joining feedpoint region 22, are bent so that the arms are approximately parallel to bracket 74 and to each other, and so that separation $W_R$ is approximately 1 cm.

Tuning parameters of antenna 10, such as $f_{HI}$, $f_{LO}$, $BW_{HI}$, and $BW_{LO}$, may be adjusted by bending different regions of the antenna. Such tuning may be performed without changing the topology of the antenna, but rather the antenna's geometry. The matching of antenna 10 to the coaxial cable feed may also be adjusted by bending different regions of the antenna, the bending acting as a form of gamma matching.

It will be understood that the tuning for antenna 10 described above may be performed before or after the antenna has been installed on bracket 74. Alternatively, the tuning may be performed by a partial, typically coarse, adjustment, before installation, followed by a further, typically fine, adjustment after installation. Further alternatively, an insulating sleeve (not shown in FIGS. 3A and 3B) may be used over loop 24 to maintain the shape of the loop after bending, and/or to bend the loop to a predetermined shape.

Figure 4A:
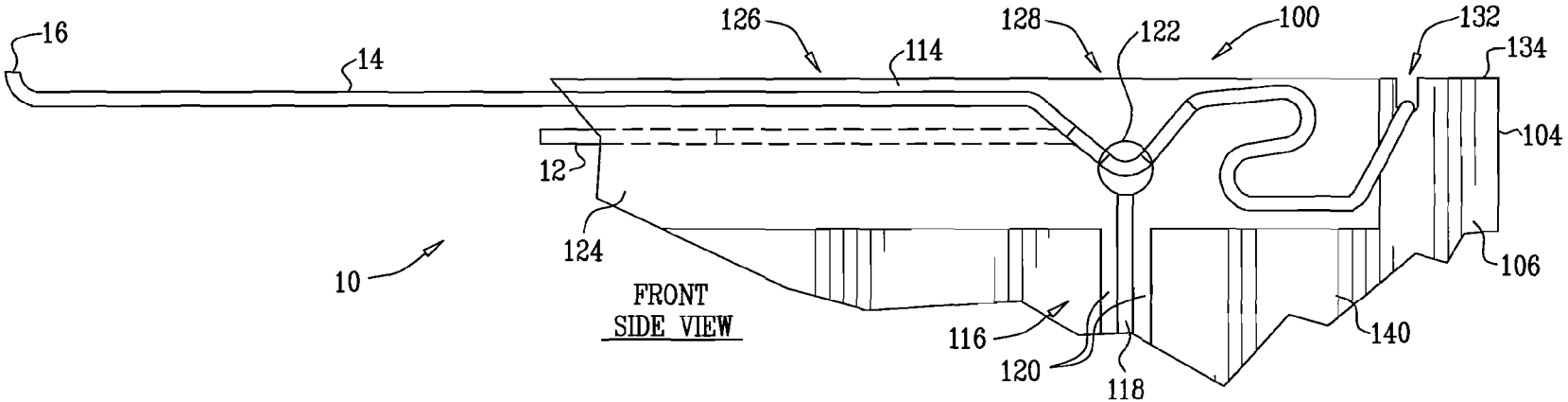
FIGS. 4A and 4B illustrate a method for mounting the antenna, according to an alternative embodiment of the present invention.
Figure 4B:
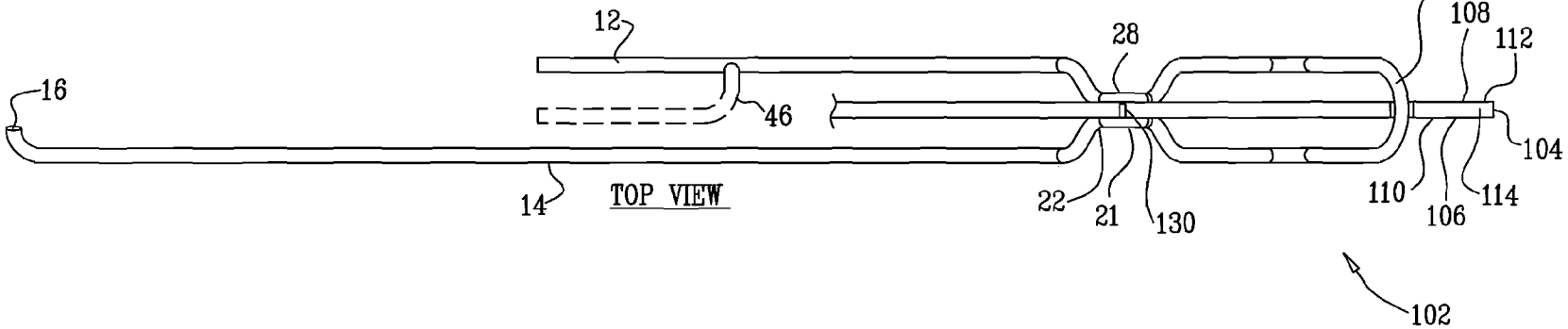

FIGS. 4A and 4B illustrate a method for mounting antenna 10, according to an alternative embodiment of the present invention. A diagram 100 shows a front side view of the antenna, and a diagram 102 shows a top view. As shown in the figure, antenna 10 is mounted on a PCB 104 so as to straddle the printed circuit board. PCB 104 has a first ground plane 110 on a front side 106, and a second ground plane 112 on a rear side 108. The ground planes are formed on a substrate 114 of the PCB.

A microstrip feedline 116 feeds antenna 10. Feedline 116 comprises a center conductor 118 formed from ground plane 110, separated from the ground plane by two sections 120 from which conductive material has been removed. Central conductor 118 terminates in a feed pad 122. A section 124 of ground plane 110, and a corresponding section 126 of ground plane 112 are removed from the PCB, leaving substrate 104 bare, apart from a feed pad 122 and a portion of conductor 118 that connects to the feed pad. A second pad 128 is left in section 126, at a position corresponding to the position of pad 122. In one embodiment, a via or plated thru hole 130 galvanically connects the two pads. Alternatively, the two pads are not connected by a conductor through the substrate, but are arranged so that there is capacitive coupling between the pads.

A generally U-shaped section 132 is configured in a top edge 134 of PCB 104, the section being surrounded by ground planes 110 and 112.

Antenna 10 is mounted in proximity to edge 134, so that end point 21 is on front side 106 of the board, and end point 23 is on rear side 108 of the board, the two end points effectively gripping the board at feed pads 122 and 128. If the feed pads are galvanically connected, as described above, loop 24 is closed galvanically. Alternatively, if the feed pads are capacitively coupled, loop 24 is closed capacitively. Semi-circular region 48 of the antenna fits into section 132. End points 21 and 23 are soldered to their respective feed pads. Region 48 is soldered to ground planes 110 and 112. Alternatively, a conductor such as a spring contact (not shown in FIGS. 4A and 4B) maintains region 48 within section 132, as well as in contact with the ground planes.

As illustrated in FIGS. 4A and 4B, sections 124 and 126 are substantially free of conducting material. The sections are configured so that apart from feed pad 122 and its connecting conductor, feed pad 128, and the sections of the ground planes surrounding U-shaped section 132, there is no conductive material between arms 12 and 14, or in close proximity to the arms. There is also no conductive material, apart from the section contacting region 48, in close proximity to loop 24. The presence of such conducting material would typically interfere with efficient operation of antenna 10.

In the configuration of FIGS. 4A and 4B, antenna 10 may be adjusted generally as described above with reference to FIGS. 3A and 3B. In addition, in the mounting example illustrated in FIGS. 4A and 4B, increased separation between arms 12 and 14 typically leads to reduced RF losses that are caused by dissipative dielectric properties of substrate 104.

It will be appreciated that embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. An antenna, comprising:

a folded looped conductor closed at a feedpoint; and at least two conductive arms extending from the feedpoint, at least one region of the folded looped conductor being operative as a ground point.

2. The antenna according to claim 1, wherein the at least two conductive arms have a common near field.

3. The antenna according to claim 1, wherein the at least two conductive arms radiate in respective wireless communication bands.

4. The antenna according to claim 1, wherein the folded looped conductor and the at least two conductive arms are formed from a single conductive element.

5. The antenna according to claim 1, wherein at least one of the folded looped conductor and the at least two conductive arms are formed from a conductive element having a circular cross-section.

6. The antenna according to claim 1, wherein at least one of the folded looped conductor and the at least two conductive arms are formed from a conductive element having a non-circular cross-section.

7. The antenna according to claim 1, wherein the antenna has an electrical characteristic, and wherein the electrical characteristic is altered by a change of geometry of at least one of the folded looped conductor and the at least two conductive arms, while maintaining a topology of the folded looped conductor and the at least two conductive arms.

8. The antenna according to claim 7, wherein the change of geometry comprises a bending of at least one of the conductive arms.

9. The antenna according to claim 7, wherein the change of geometry comprises a change in folding of the folded looped conductor.

10. The antenna according to claim 1, wherein the folded looped conductor is configured to receive a coaxial cable, so that the feedpoint contacts a central conductor of the cable, and so that at least one region of the folded loop contacts a shield of the cable.

11. The antenna according to claim 1, wherein the folded looped conductor comprises a plurality of first regions lying in a first plane and a plurality of second regions lying in a second plane that is parallel to and separate from the first plane.

12. The antenna according to claim 1, wherein the folded looped conductor comprises two ends which are galvanically coupled so as to close the folded looped conductor galvanically at the feedpoint.

13. The antenna according to claim 1, wherein the folded looped conductor comprises two ends which are capacitively coupled so as to close the folded looped conductor capacitively at the feedpoint.

14. An antenna comprising:

a folded looped conductor closed at a feedpoint;

at least two conductive arms extending from the feedpoint; and a printed circuit board (PCB), the folded looped conductor and the at least two conductive arms being disposed to straddle the PCB so that the PCB is gripped by the folded looped conductor at the feedpoint.

15. An antenna and comprising:

a folded looped conductor closed at a feedpoint;

at least two conductive arms extending from the feedpoint; and a printed circuit board (PCB) having a ground plane disposed on a side of the PCB, the folded looped conductor and the at least two conductive arms being disposed to straddle the PCB so that a region of the folded looped conductor galvanically contacts the ground plane.

16. An antenna comprising:

a folded looped conductor closed at a feedpoint; and at least two conductive arms extending from the feedpoint, the folded looped conductor comprising a plurality of first regions lying in a first plane and a plurality of second regions lying in a second plane parallel to and separate from the first plane, the folded looped conductor having a plane of symmetry parallel to the first and the second plane.

17. An antenna comprising:

a folded looped conductor closed at a feedpoint; and at least two conductive arms extending from the feedpoint, the folded looped conductor comprising two straight parallel regions which are configured to connect galvanically to a conductive ground plane.

* * * * *